US009320936B1

(12) United States Patent
Rea et al.

(10) Patent No.: US 9,320,936 B1
(45) Date of Patent: Apr. 26, 2016

(54) SELECTIVELY ADJUSTABLE, PORTABLE EXERCISE SYSTEM

(71) Applicants: Christopher Rea, Weehawkin, NJ (US); James C. Wickstead, Mendham, NJ (US)

(72) Inventors: Christopher Rea, Weehawkin, NJ (US); James C. Wickstead, Mendham, NJ (US)

( * ) Notice: Subject to any disclaimer, the term of this patent is extended or adjusted under 35 U.S.C. 154(b) by 176 days.

(21) Appl. No.: 14/333,448

(22) Filed: Jul. 16, 2014

Related U.S. Application Data

(60) Provisional application No. 61/846,753, filed on Jul. 16, 2013.

(51) Int. Cl.
*A63B 21/015* (2006.01)
*A63B 21/018* (2006.01)

(52) U.S. Cl.
CPC ..... *A63B 21/018* (2013.01)

(58) Field of Classification Search
CPC ..... A63B 21/018; A63B 21/00058; A63B 21/00069; A63B 21/00072; A63B 21/02; A63B 21/023; A63B 21/025; A63B 21/153; A63B 2022/0079
See application file for complete search history.

(56) References Cited

U.S. PATENT DOCUMENTS 1,402,179 A 1/1922 Piscitelli
4,174,832 A * 11/1979 Thompson ..... A63B 21/018 482/120
4,208,049 A 6/1980 Wilson
4,944,511 A 7/1990 Francis
5,358,461 A * 10/1994 Bailey, Jr. ..... A63B 21/0053 290/1 R
5,618,249 A * 4/1997 Marshall ..... A63B 21/153 482/115
5,637,062 A 6/1997 Schmittner
5,733,231 A * 3/1998 Corn ..... A63B 21/025 482/120
5,876,310 A 3/1999 Mackey et al.
6,283,899 B1 9/2001 Charnitski
6,440,044 B1 8/2002 Francis et al.
6,685,602 B2 2/2004 Colosky, Jr. et al.
7,037,246 B2 5/2006 Kim
7,229,391 B2 6/2007 Francis
7,250,021 B2 7/2007 Leight
7,637,853 B2 12/2009 Crowson et al.
7,871,359 B2 1/2011 Humble et al.
7,878,955 B1 * 2/2011 Ehrlich ..... A63B 21/025 482/127
2002/0025891 A1 2/2002 Colosky, Jr. et al.
2011/0237407 A1 * 9/2011 Kaleal ..... A63B 21/025 482/114
2012/0116259 A1 5/2012 McConnell et al.

* cited by examiner

*Primary Examiner* — Oren Ginsberg
*Assistant Examiner* — Nyca T Nguyen
(74) *Attorney, Agent, or Firm* — Thomas P. O'Connell; O'Connell Law Firm

(57) ABSTRACT

A selectively adjustable, portable exercise system with first and second resistance mechanisms, each with a rotatable spool, a cord wrapped around the spool, a handle secured to the cord, and a resistance stack formed by plural resistance packs, which can be modular. The spool and the resistance pack have engagement patterns. Each resistance pack presents a resistance to rotation, such as by a coil spring. Each of a plurality of keys has a rod portion with an engagement pattern with a spool engagement pattern to lock the spool relative to the key and a resistance pack engagement pattern for locking one or more resistance packs relative to the key and the spool. The resistance pack engagement patterns of at least some of the keys vary to lock different combinations of resistance packs relative to the key and the spool. A belt, base platforms, or both can form a retaining structure.

23 Claims, 10 Drawing Sheets

SELECTIVELY ADJUSTABLE, PORTABLE EXERCISE SYSTEM

FIELD OF THE INVENTION

The present invention relates generally to exercise systems for resistance training. More particularly, disclosed herein is a portable exercise system that is versatile in use and adjustable in resistance by a selective, intuitive engagement of a plurality of resistance packs to permit a wide range of resistance exercises under user-selected resistance.

BACKGROUND OF THE INVENTION

Under the teachings of the prior art, resistance training primarily relies on a user's raising, lowering, or otherwise manipulating what are commonly referred to as free weights, which often take the form of weighted plates that are selectively applied to or removed from barbells or dumbbells to permit an adjustment of the overall weight to be manipulated. Other free weights are fixed in configuration, such as by having a central handle portion with first and second bulbous weights at opposed ends thereof.

While such free weights can be raised, lowered, and otherwise manipulated with good effectiveness, their use is limited. For example, although the individual components may be somewhat portable, the overall free weight system necessary to provide selective resistance weights is difficult to transport due not only to the inherent weight of the components but also due to the multiplicity of awkward plates, bars, and fasteners that would need to be packed and carried. Free weights are further limited in that their operation relies on the effects of gravity in relation to the various levers and propulsion systems that can be formed by the human body. It will also be appreciated that free weights are of substantially no use in weightless environments. Even under the force of gravity, resistance provided by free weights will vary, sometimes undesirably, with the moment arm over which the user's arms, legs, or other body parts act.

A number of inventors have sought to provide portable exercise systems and exercise apparatuses not dependent on free weight. For example, in U.S. Pat. No. 4,208,049 for a Constant Force Spring Powered Exercising Apparatus, Wilson teaches what is characterized as a multi-functional exercise apparatus that employs a plurality of constant force springs. The springs can be chosen individually or in groups to provide a selected resistance during exercise. However, the Wilson system is complex in construction and requires mounting to a large support platform that again renders the system effectively non-portable. With U.S. Pat. No. 5,618,249 for Unidirectionally Adjustably Resistant Recoilers and Portable Exercise Devices, Marshall discloses an upper body exercise device with two spring-loaded recoilers retained by a waist pouch. The system is advantageous for its portability, but the user is limited to the resistance of a single recoil mechanism for each arm, leg, or other body part. With that, the system is inherently limited in its range of resistance and use. Still further, in U.S. Pat. No. 5,733,231 for an Exercise Device with Variable Resistance, Corn et al. discloses an exercise device with resistance mechanisms to resist each of a plurality of cords as the cords are withdrawn from a retracting mechanism. While the system provides removable disks for incrementally increasing resistance force, the retention, removal, and selection of the several resistance disks are relatively complex and do not appear to be as intuitive as would be desired for the average user. Also contributing to the state of the art is United States Patent Application Publication No. 2002/0025891 of Colosky, Jr. et al. for a Gravity-Independent Constant Force Resistive Exercise Unit. There, Colosky describes an exercise unit with modular resistive packs retaining constant torque springs to provide constant forces opposing the withdrawal of an exercise cable. While a user can select from multiple resistive packs, the overall system is disposed in a large housing and could not be readily portable or retained easily in relation to a human body. Accordingly, the application of the exercise unit is inherently limited.

Still other exercise systems of the prior art rely on simple coil springs or elastic cords that are attempted to be retained by the user's own body to provide resistance. While such systems are advantageous for their simplicity and while they may permit a user to alter resistance forces by physically adding or removing springs or bungees, they are cumbersome to use and can present dangers to the user due to misuse and malfunction.

Accordingly, it will be appreciated that there is a need for an exercise system capable of selective resistance adjustment by the user that enables consistent, user-selected resistance over an exercise movement. There is also a demonstrated need for an exercise system that is readily portable, such as by being able to be retained and transported by a direct coupling to the human body. Still further, there is a recognized need for an exercise system that is safe and comfortable in use while permitting an adjustment of resistance in a convenient and intuitive way.

SUMMARY OF THE INVENTION

With a knowledge of the present state of the art, the present inventors set forth with the basic object of providing an exercise system capable of selective resistance adjustment by the user.

A further object of the invention is to provide an exercise system that is readily portable and that requires a relatively limited space during use.

In particular embodiments, an object of the invention is to provide an exercise system that is capable of being retained and transported by a direct coupling to the human body, such as by retention about a human waist or in relation to a user's feet.

Still another object of the invention is to provide an exercise system that permits an adjustment of resistance, such as by a selection of resistance packs, in a convenient and intuitive manner.

Another object of the invention in particular embodiments is to provide an exercise system that exhibits generally constant resistance force across an entire anticipated range of movement.

These and further objects and advantages of the present invention will become obvious not only to one who reviews the present specification and drawings but also to those who have an opportunity to experience an embodiment of the exercise system disclosed herein in use. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the foregoing objects, an embodiment of the present invention for a selectively adjustable, portable exercise system can be include at least a first resistance mechanism comprising a rotatable spool, a cord wrapped around the rotatable spool, a handle secured to the cord, and a resistance stack. The rotatable spool and each resistance pack has an engagement pattern. The resistance stack comprises a plurality of resistance packs, and each resistance pack presents a resistance to rotation. A plurality of keys can be employed with each key having a rod portion with an engagement pattern longitudinally spaced therealong. The engagement pattern of each key has a spool engagement pattern for engaging the engagement pattern of the rotatable spool to lock the rotatable spool relative to the key and a resistance pack engagement pattern for engaging the engagement pattern of one or more resistance packs to lock the one or more resistance packs relative to the key and the rotatable spool. The resistance pack engagement patterns of at least some of the plurality of keys vary to lock different combinations of resistance packs relative to the key and the rotatable spool.

To enable dual, simultaneous exercises, such as by both arms of a user, the exercise system can further include a second resistance mechanism. The second resistance mechanism can have a rotatable spool, a cord wrapped around the rotatable spool, and a handle secured to the cord. The rotatable spool and each resistance pack can have an engagement pattern. The resistance stack can be formed by a plurality of resistance packs, and each resistance pack can present a resistance to rotation.

In certain practices of the invention, each resistance pack can present resistance to rotation by operation of a spring, such as a coiled, constant force spring, to present resilient resistance to rotation. In such embodiments, the spring of each resistance pack can have a first end portion coupled to the resistance pack for rotation with the resistance pack and a second end fixed against rotation with the resistance pack. At least some of the plurality of resistance packs can present different resistances to rotation.

The plurality of resistance packs can nest together. For example, each resistance pack can have an annular hub that projects concentrically from a first side of the resistance pack and an annular receiving shoulder concentrically disposed to a second side of the resistance pack. In those and other manifestations of the invention, the plurality of resistance packs can be modular and interchangeable.

Each resistance pack can have a concentric through-hole, and the engagement pattern of each resistance pack can then be disposed over the concentric through-hole. While the engagement patterns can vary, the engagement patterns of the resistance pack and the plurality of keys can comprise spline patterns.

Embodiments of the exercise system can, by way of example and not limitation, have at least first, second, and third resistance packs and at least first, second, and third keys. The first key can have a resistance pack engagement pattern for locking only the first resistance pack to rotate with the key and the rotatable spool. The second key can have a resistance pack engagement pattern for locking the first and second resistance packs to rotate with the key and the rotatable spool, and the third key can have a resistance pack engagement pattern for locking the first, second, and third resistance packs to rotate with the key and the rotatable spool.

As disclosed herein, the rotatable spool can have a spool core and first and second sidewalls. There, the cord can be wrapped around the spool core. Even further, the spool core can have a tapered outer surface from the second sidewall to the first sidewall, which can facilitate a consistent resistance to a pulling of the cords and a winding of the rotatable spool.

A retaining structure can be provided to retain the first and second resistance mechanisms. For instance, the retaining structure could take the form of a belt so that the exercise system can be retained by an encircling with the belt. Alternatively or additionally, the retaining structure can comprises at least one base platform, potentially first and second base platforms, so that the exercise system can be retained by a restraining force applied to the at least one base platform.

In certain practices of the invention, the at least one base platform can be disposed generally perpendicularly to the belt. The at least one base platform could, for example, project generally parallel to an axis of rotation of the rotatable spool. To facilitate retaining the base platform or platforms relative to a user's feet or another structure, at least one retaining strap can be retained relative to the at least one base platform. Still further, the retaining structure could include a base member, which could be rigid, and the first and second resistance mechanisms can be slidably retained relative to the base member.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The selectively adjustable, portable exercise system disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
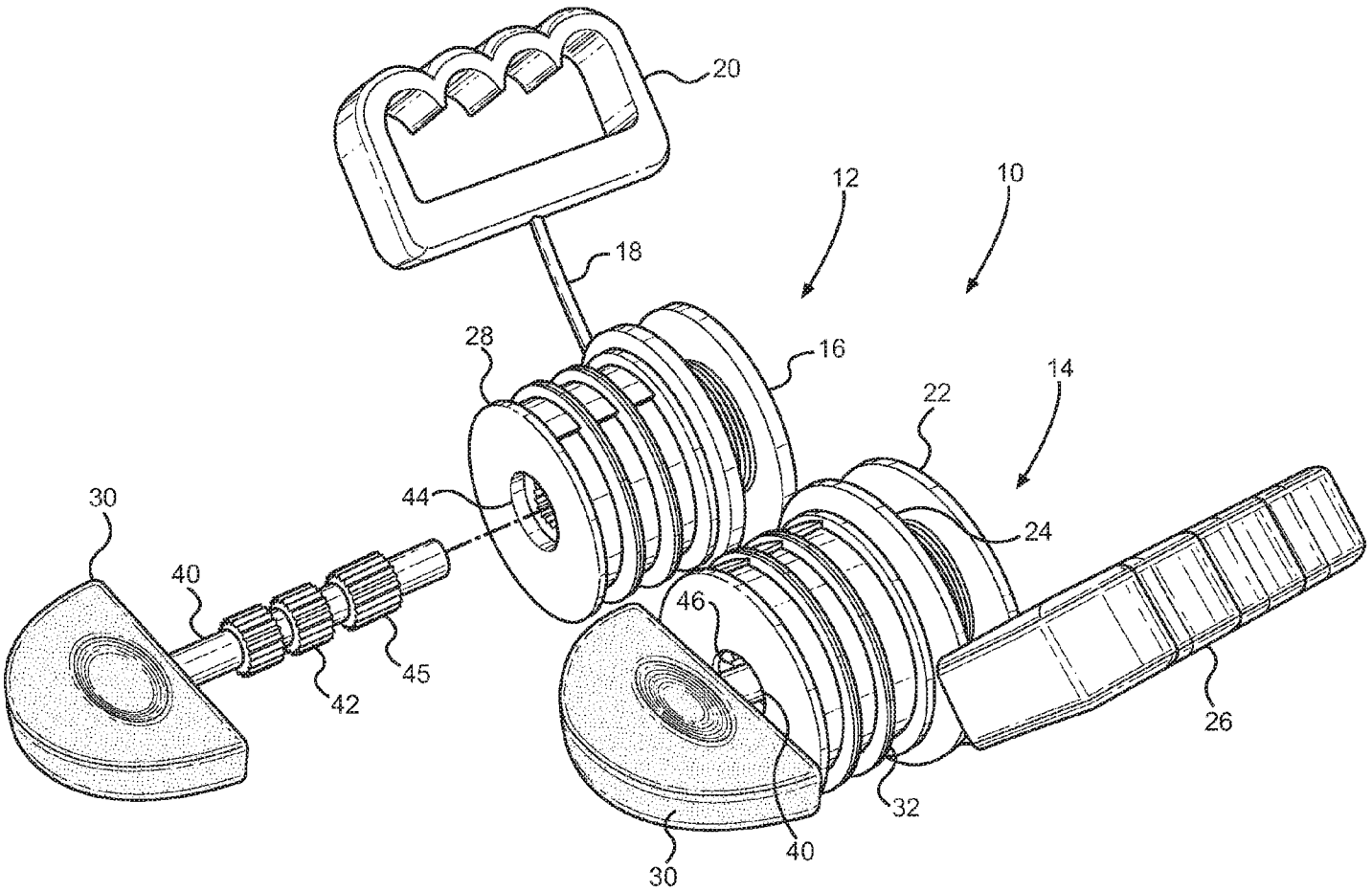
FIG. 1 is a perspective view of a selectively adjustable, portable exercise system according to the invention disclosed herein.
Figure 2:
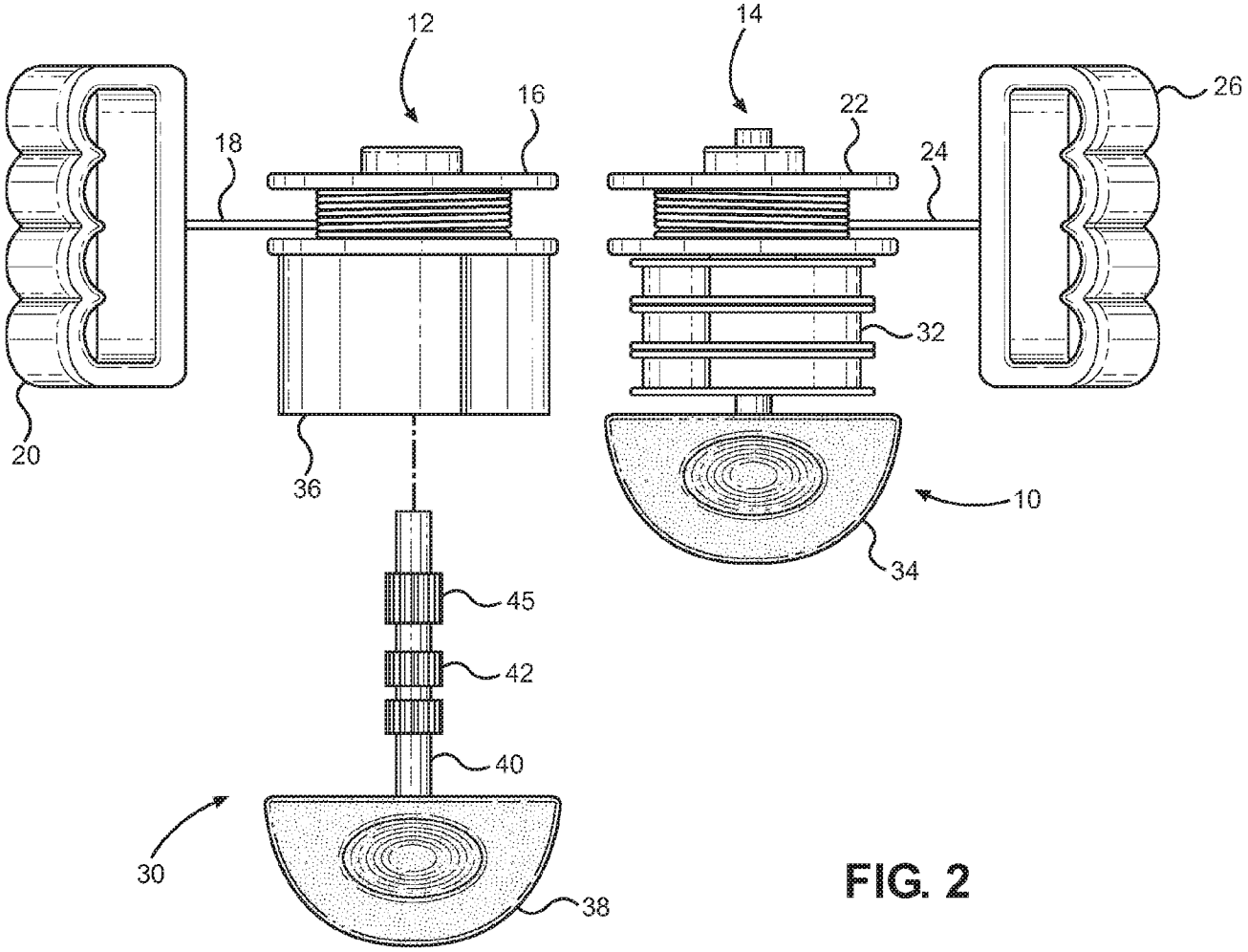
FIG. 2 is a top plan view of the exercise system of FIG. 1.
Figure 3:
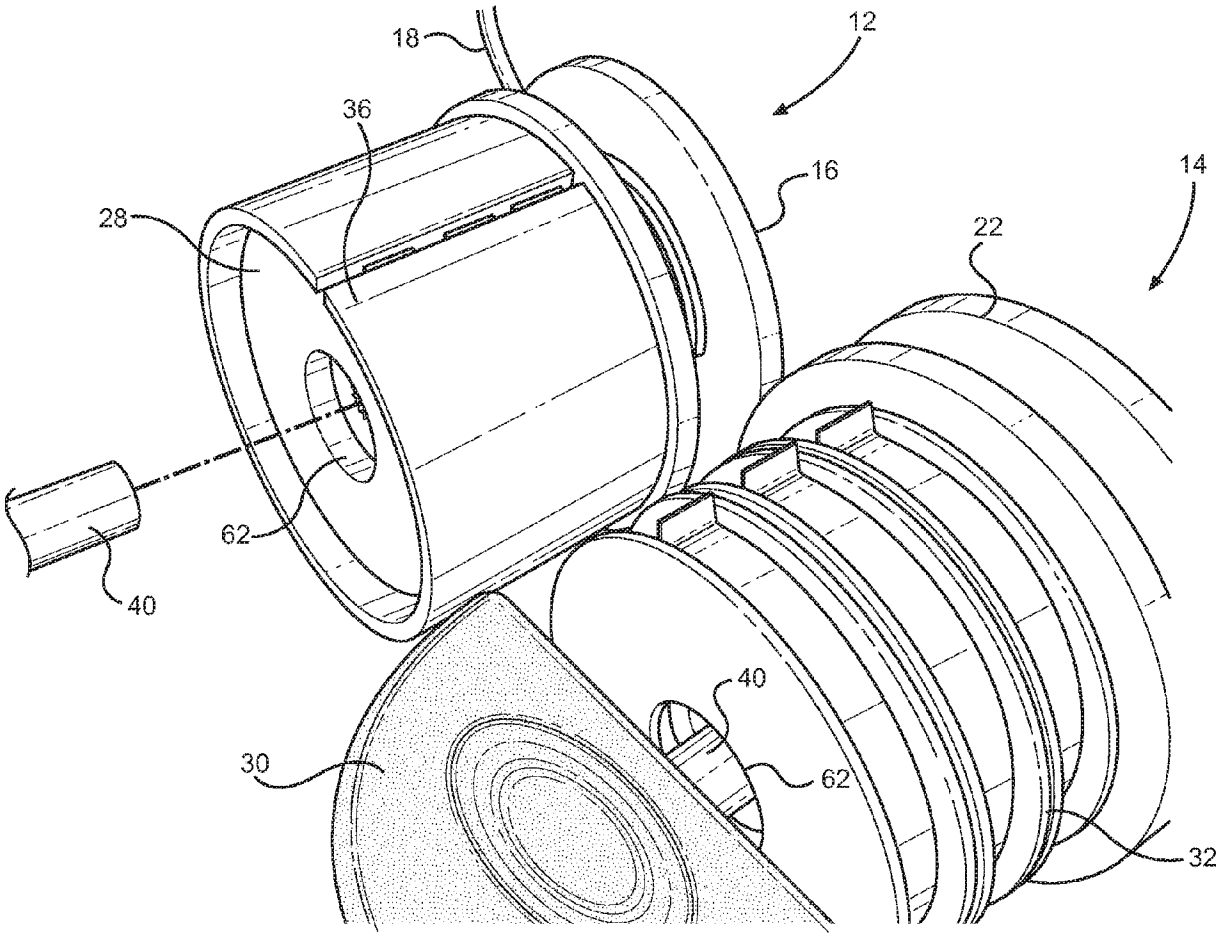
FIG. 3 is a perspective view of first and second resistance mechanisms according to the invention in different stages of assembly.

Turning more particularly to the drawings, an exercise system according to the present invention is indicated generally at 10 in FIGS. 1 and 2. There, the exercise system 10 has a first resistance mechanism 12 and a second resistance mechanism 14. The first resistance mechanism 12 has a rotatable spool 16 around which is wound a cord 18, which may be non-resilient. A handle 20 is fixed to a distal end of the cord 18. A first spring stack 28 is coupled to the spool 16 to provide resistance to the rotation of the spool 16 as the handle 20 is used to unwind the cord 18 therefrom. Similarly, the second resistance mechanism 14 has a rotatable spool 22 around which is wound a cord 24. A handle 26 is fixed to a distal end of the cord 24. A second spring stack 32 is coupled to the spool 22 to provide resistance to the rotation of the spool 16 as the handle 26 is used to unwind the cord 24 therefrom.

The spring stacks 28 and 32 are depicted as being fully exposed in FIG. 1 for clarity, but it will be understood that a shroud 36 or other housing as shown, for example, in FIG. 2 relative to the first resistance mechanism 12 could be employed to increase the safety, durability, and aesthetic appeal of the exercise system 10. As described further hereinbelow, the resistance mechanisms 12 and 14 provides adjustable resistance to the unwinding of the cords 18 and 24 from the respective spools 16 and 22 by a selective engagement of resistance selection keys 30 with the first and second spring stacks 28 and 32.

Figure 11:
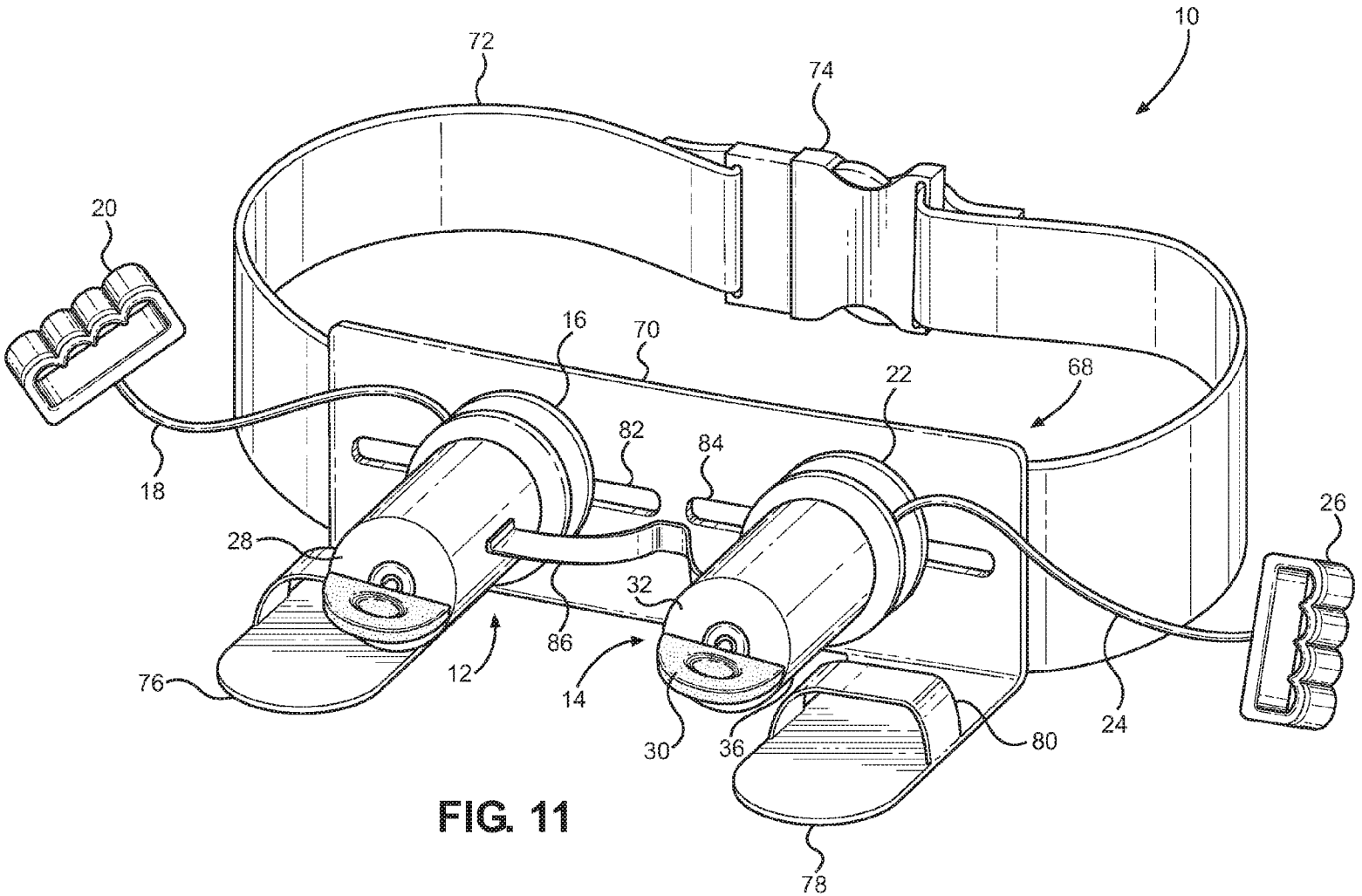
FIG. 11 is a perspective view of an embodiment of the exercise system disclosed herein.

In use, the resistance mechanisms 12 and 14 can be retained for operation by a user. By way of example and not limitation, the resistance mechanisms 12 and 14 could be secured to a user's waist, such as by a belt 72 that is secured to a base member 70 of a retaining structure 68 that securely retains the resistance mechanisms 12 and 14 as depicted, for instance, in FIG. 11. Alternatively, the resistance mechanisms 12 and 14 could be selectively retained relative to a user's feet or other body part or in relation to another structure or article. In such embodiments, the first and second resistance mechanisms 12 and 14 could be retained or fixed in relation to one another by any effective arrangement, such as a base platform or base platforms 76 and 78 as shown in FIG. 11, a rigid retaining member, or some other construction. Indeed, as described further hereinbelow and as is shown in the embodiment of FIG. 11, it is possible to have a combined retaining structure 68 that permits selective retention of the exercise system 10 in multiple formats, such as about a wearer's waist by a belt 72 or under a user's feet or knees by one or more base platforms 76 and 78. Accordingly, the invention need not be limited to any particular retaining structure, except as it might be expressly limited by the claims.

Figure 4:
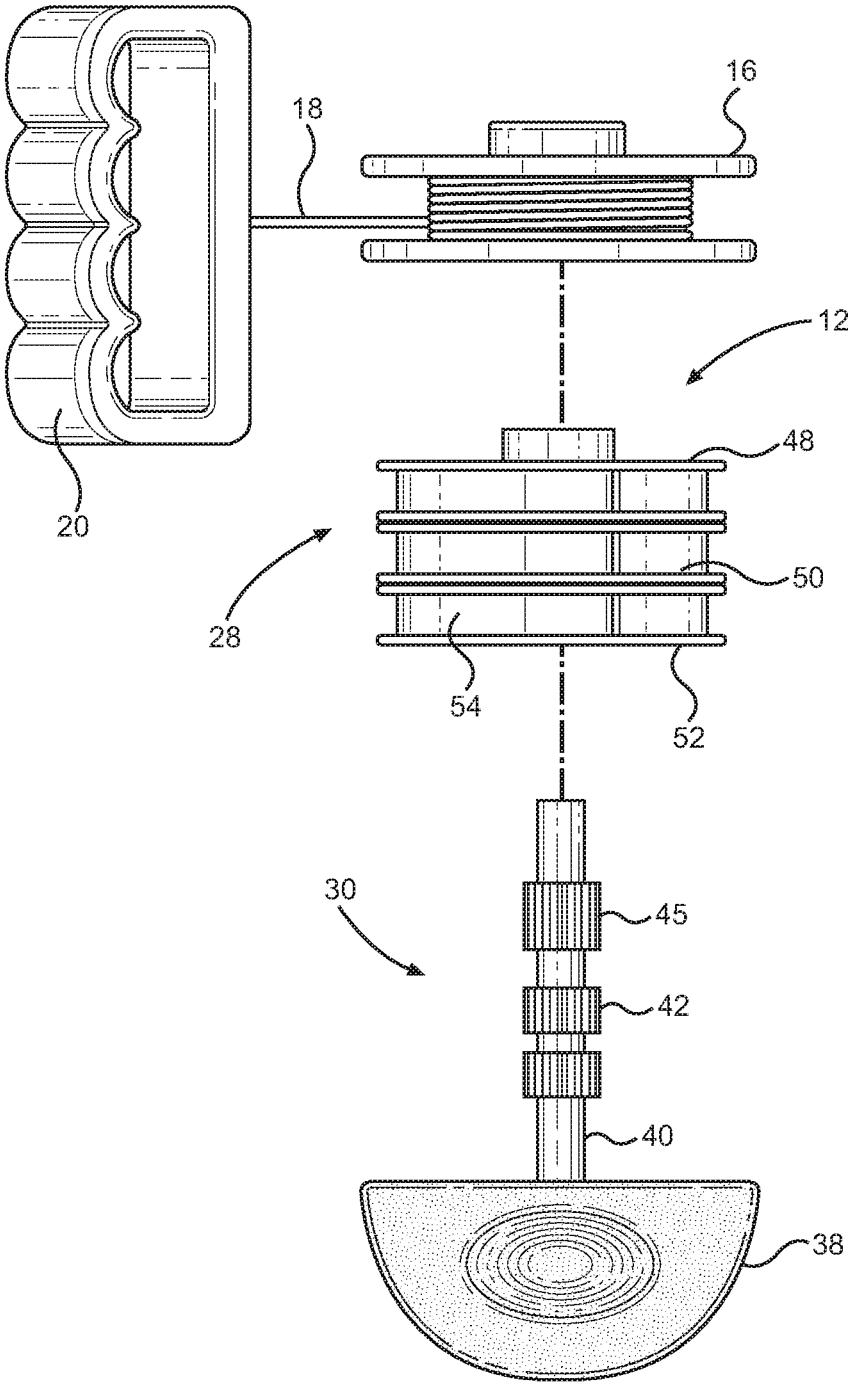
FIG. 4 is a partially exploded top plan view of the first resistance mechanism.

As illustrated, for example, in FIG. 4 relative to the first resistance mechanism 12, each spring stack 30 is constructed with a plurality of resistance packs 48, 50, and 52. Each resistance pack 48, 50, and 52 has a coiled spring 54, which may be a constant force spring, to provide resistance to a rotation of the resistance pack 48, 50, and 52 and, derivatively, the cords 18 and 24 as they are unwound from the spools 16 and 22 by a pulling on the handles 20 and 26. In one embodiment, for example, the resistance packs 48, 50, and 52 can have coiled springs 54 with an internal end fixed in relation to an inner core 65 of the respective resistance pack 48, 50, and 52 and an external end fixed externally to the resistance pack 48, 50, or 52, such as by being fixed to the housing 36 of the resistance mechanism 12 or 14. The housing 36 can be fixed against rotation, such as by being fixed to a base platform 70 by a brace 86 as in FIG. 11 or in some other manner. In any event, the coiled springs 54 of the resistance packs 48, 50, and 52 can provide the same resistance. Alternatively, some or all of the resistance packs 48, 50, and 52 can provide different resistances, such as by use of coiled springs 54 of different spring constants.

In the depicted embodiment, there are three resistance packs 48, 50, and 52, but it will be clear that any multiplicity of resistance packs 48, 50, and 52 may be employed within the scope of the invention. The resistance packs 48, 50, and 52 can nest together or otherwise be retained. In this embodiment, the resistance packs 48, 50, and 52 nest together by a hub 66 that projects concentrically from a first side of each resistance pack 48, 50, and 52 in combination with an annular receiving shoulder 64 concentrically disposed to a second side of each resistance pack 48, 50, and 52.

Figure 10:
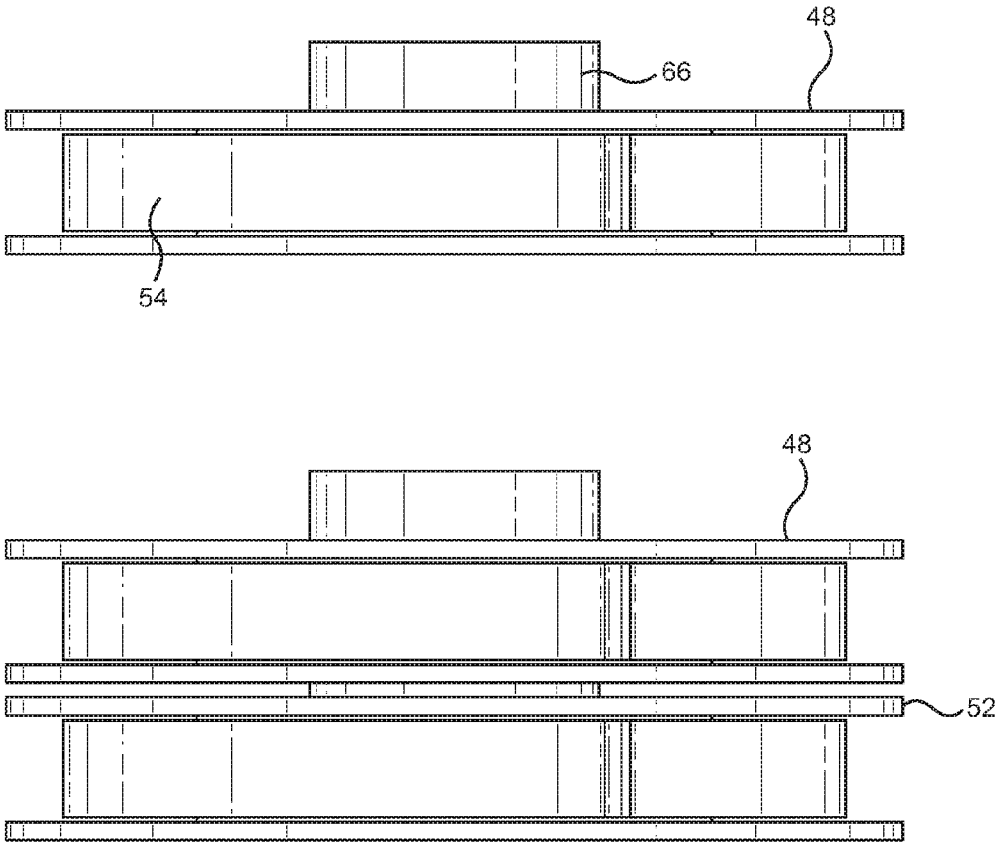
FIG. 10 is a top plan view of a stack of spring resistance packs pursuant to the invention.

With that, two or more resistance packs 48, 50, and 52 can be selected and stacked as in FIG. 10 at the selection of the user. The interchangeability and modularity of the resistance packs 48, 50, and 52 can permit a user to select different pluralities and combinations of resistance packs 48, 50, and 52. For instance, a user might select two, three, or more identical packs 48, 50, and 52, or the user might select two, three, or more packs 48, 50, and 52 with at least some packs 48, 50, and 52 demonstrating different resistances.

Figure 8:
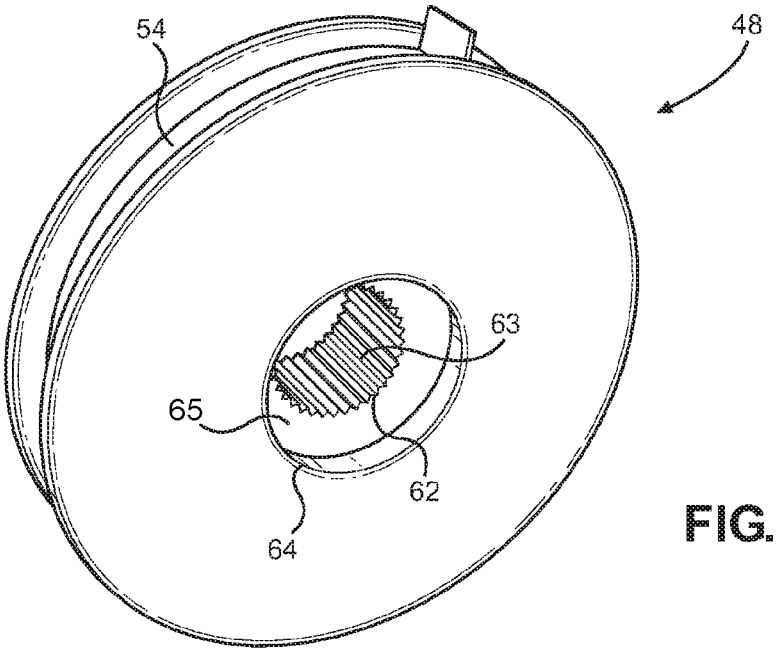
FIG. 8 is a perspective view of a resistance pack as taught herein.
Figure 9:
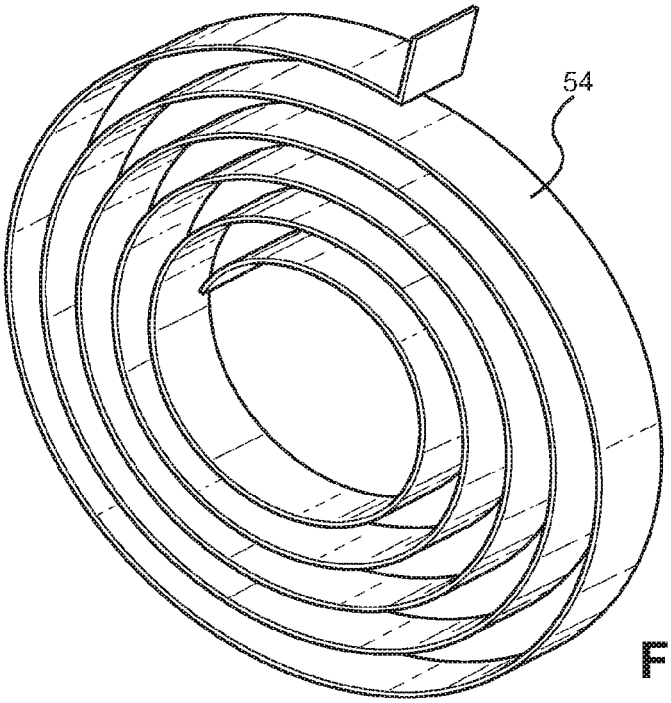
FIG. 9 is a perspective view of a constant force spring.

By combined reference to FIGS. 1 through 5 and most particularly FIG. 8, one can perceive that each resistance pack 48, 50, and 52 has an engagement pattern 63, such as by being keyed or otherwise formed to be selectively and positively engaged. Of course, the engagement pattern 63 can be accomplished in myriad different ways, each within the scope of the invention except as the claims might expressly limit the keying. Here, the engagement pattern 63 is accomplished by splines 63 formed over the inwardly facing surface of a concentric through-hole 62. The through-hole 62 with the engagement pattern 63 combines with a key 30 that has an engagement pattern 42, which can be a mating engagement pattern. The splined, concentric through-holes 62 of the multiplicity of resistance packs 48, 50, and 52 can be the same or different in diameter, engagement pattern 63, or otherwise, or they can be substantially identical. The splines 63 could, for example, be serrated splines 63. As will be described further hereinbelow, the multiplicity of resistance packs 48, 50, and 52 can be selectively engaged to provide resistance to the rotation of the spools 16 and 22.

As in the depicted embodiment of FIGS. 1 through 4, the resistance packs 48, 50, and 52 can be selectively engaged by use of the key 30. The key 30 has a handle 38 for enabling insertion, removal, and manipulation of the key 30. A rod portion 40 projects from the handle 38 for being inserted into the through holes 62 of the resistance packs 48, 50, and 52. An resistance pack engagement pattern 42, such as a key or resistance spline pattern 42, is disposed along the rod portion 40 for engaging the engagement patterns 63 of the through-holes 62 of the resistance packs 48, 50, and 52 and selectively locking the key 30 in relation to one or more thereof. A spool engagement pattern 45 is disposed adjacent to the distal end of the rod portion 40 for locking the key 30 in relation to the respective spool 16 or 22, which also has a concentric, through-hole and a hub 44 with an engagement pattern 42 as seen in the partially sectioned view of FIG. 6.

Figure 5:
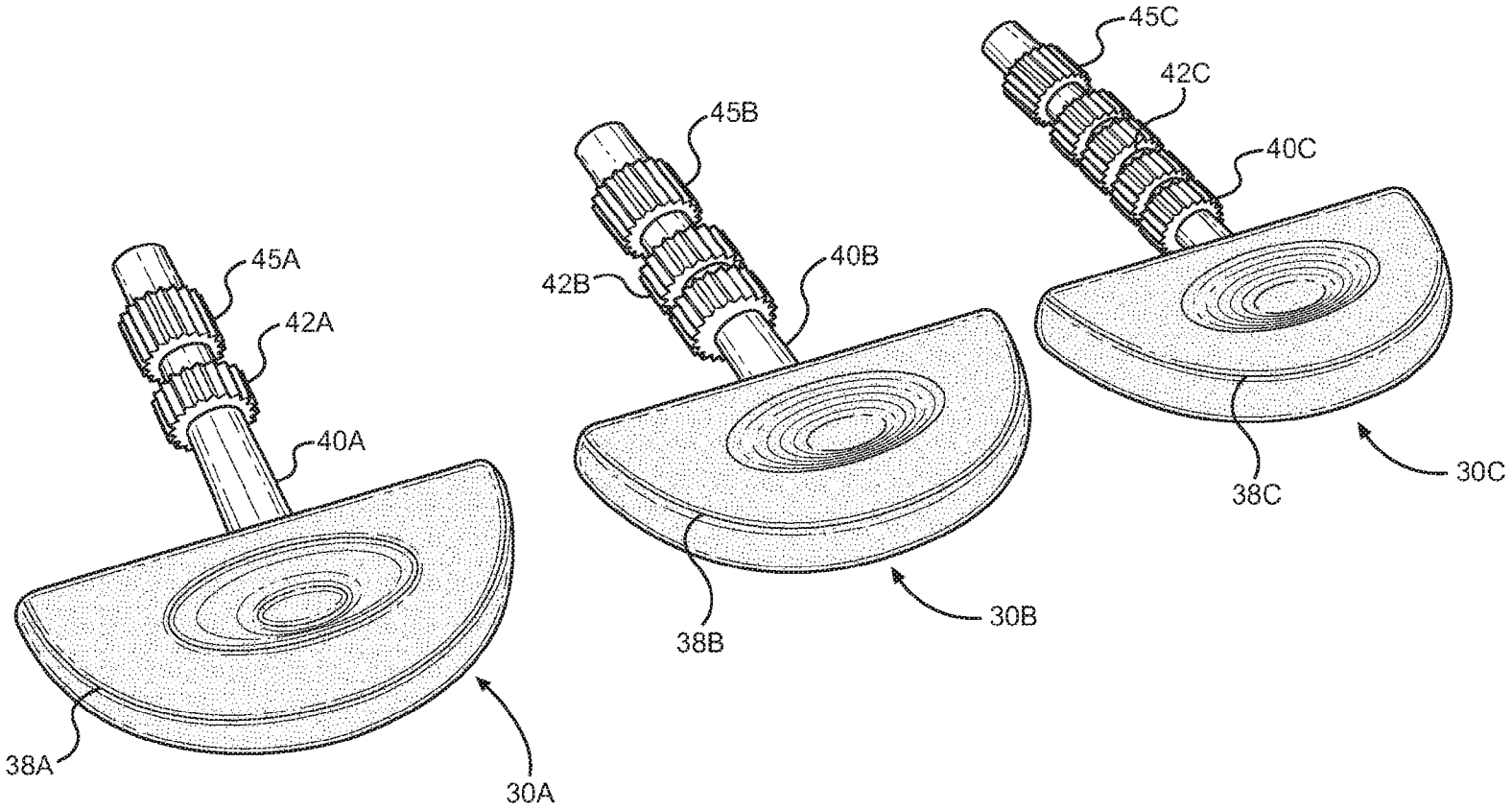
FIG. 5 is a perspective view of a plurality of resistance keys as taught herein.

The resistance spline pattern 42 on a single key 30 or the spline patterns 42A, 42B, and 42C on rods 40A, 40B, and 40C on multiple keys 30A, 30B, and 30C as shown in FIG. 5 can be used to engage the resistance packs 48, 50, and 52 selectively. With that, by a selective disposition of a key 30 or by the use of different keys 30A, 30B, and 30C, for example, a user can engage just one resistance pack 48, 50, or 52 or any combination of resistance packs 48, 50, and 52 to achieve a desired resistance.

More particularly, as will be seen from FIG. 5, a first key 30A according to the invention could have a spool spline 45A for locking in relation to the respective spool 16 or 22 and then a spline pattern 42A with just a single spline portion for locking only the first resistance pack 48 to rotate with the key 30A and the spool 16 or 22. A second key 30B has a spool spline 45B for locking in relation to the respective spool 16 or 22 and then a spline pattern 42B with first and second spline portions longitudinally spaced on the rod 40B for locking the first and second resistance packs 48 and 50 to rotate with the key 30B and the spool 16 or 22. A third key 30C has a spool spline 45C for locking in relation to the respective spool 16 or 22 and then a spline pattern 42C with first, second, and third spline portions longitudinally spaced on the rod 40C for locking the first, second, and third resistance packs 48, 50, and 52 to rotate with the key 30C and the spool 16 or 22. Where a given resistance pack 48, 50, or 52 is not engaged by the spline pattern 42A, 42B, or 42C of the respective key 30A, 30B, or 30C, that resistance pack 48, 50, or 52 does not provide resistance to the unwinding of the respective spool 16 or 22. Of course, other key combinations are possible, including with further resistance packs 48, 50, and 52 beyond three in any combination or in through some other permutation taking advantage of the present invention.

The keys 30A, 30B, and 30C can be coded, such as by color coding, by shape, by markings, or by some other coding method or combination thereof. With that, a user can be aware of the general or specific nature of the resistance to be provided by a simple recognition of the coding, such as the color coding, of the respective key 30A, 30B, or 30C. For instance, in one non-limiting example, the first key 30A could be yellow, the second key 30B could be red, and the third key 30C could be blue.

Again, other spline configurations are possible such that, by way of example and not limitation, the first and third resistance packs 48 and 52 could be engaged or the second and third resistance packs 50 and 52 could be engaged. Such permutations may be particularly advantageous where the resistance packs 48, 50, and 52 demonstrate different levels of resistance. With this, by a simple selection and insertion of a particular key 30A, 30B, or 30C, a user can cause the resistance mechanisms 12 and 14 to provide any desired resistance from a single resistance pack 48, 50, and 52 to any combination of resistance packs 48, 50, and 52 corresponding to the spline patterns 42A, 42B, and 42C.

The resistance mechanisms 12 and 14 can thus be configured to provide substantially identical resistance or to have different resistances as might be required, for instance, where a user is undergoing physical rehabilitation, where a user has a disability, or for some other reason. Moreover, a highly flexible resistance matrix is available to the user resulting from the ability to select individual or multiple resistance packs 48, 50, and 52 by the series of splined keys 30A, 30B, and 30C with it again being noted that the depicted number of resistance packs 48, 50, and 52 and keys 30A, 30B, and 30C is merely an example of one manifestation of the invention. Fewer or more packs 48, 50, and 52 are expressly contemplated, and key configurations are limited only mathematically by the possible permutations of packs 48, 50, and 52 that are included.

Figure 6:
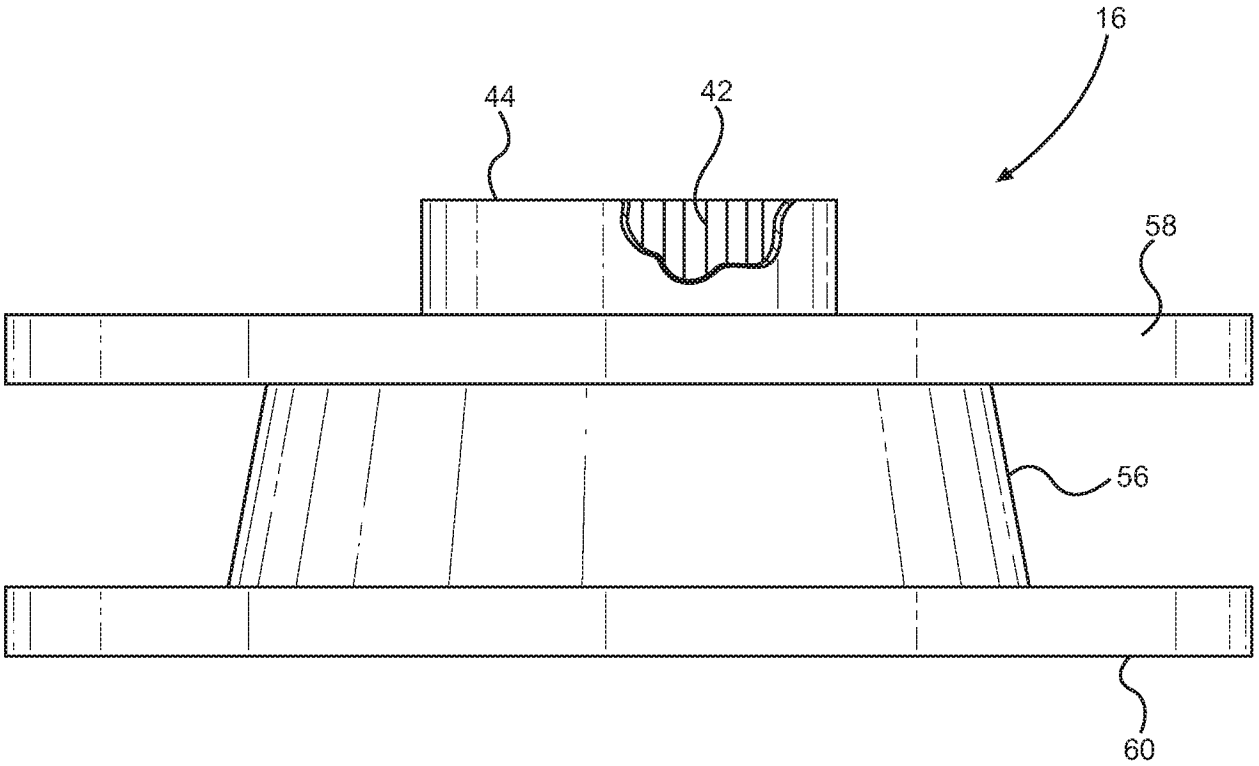
FIG. 6 is a top plan view of a resistance spool according to the invention.

As shown in FIG. 6 in relation to the first spool 16, each spool 16 and 22 can have a spool core 56 around which the cord 18 or 24 can be wound. The spool 16 has first and second sidewalls 58 and 60. The spool core 56 is disposed between the first and second sidewalls 58 and 60, and a splined spool hub 44 permits the selective reception and engagement of the rod portion 40 of the key 30.

Figure 7:
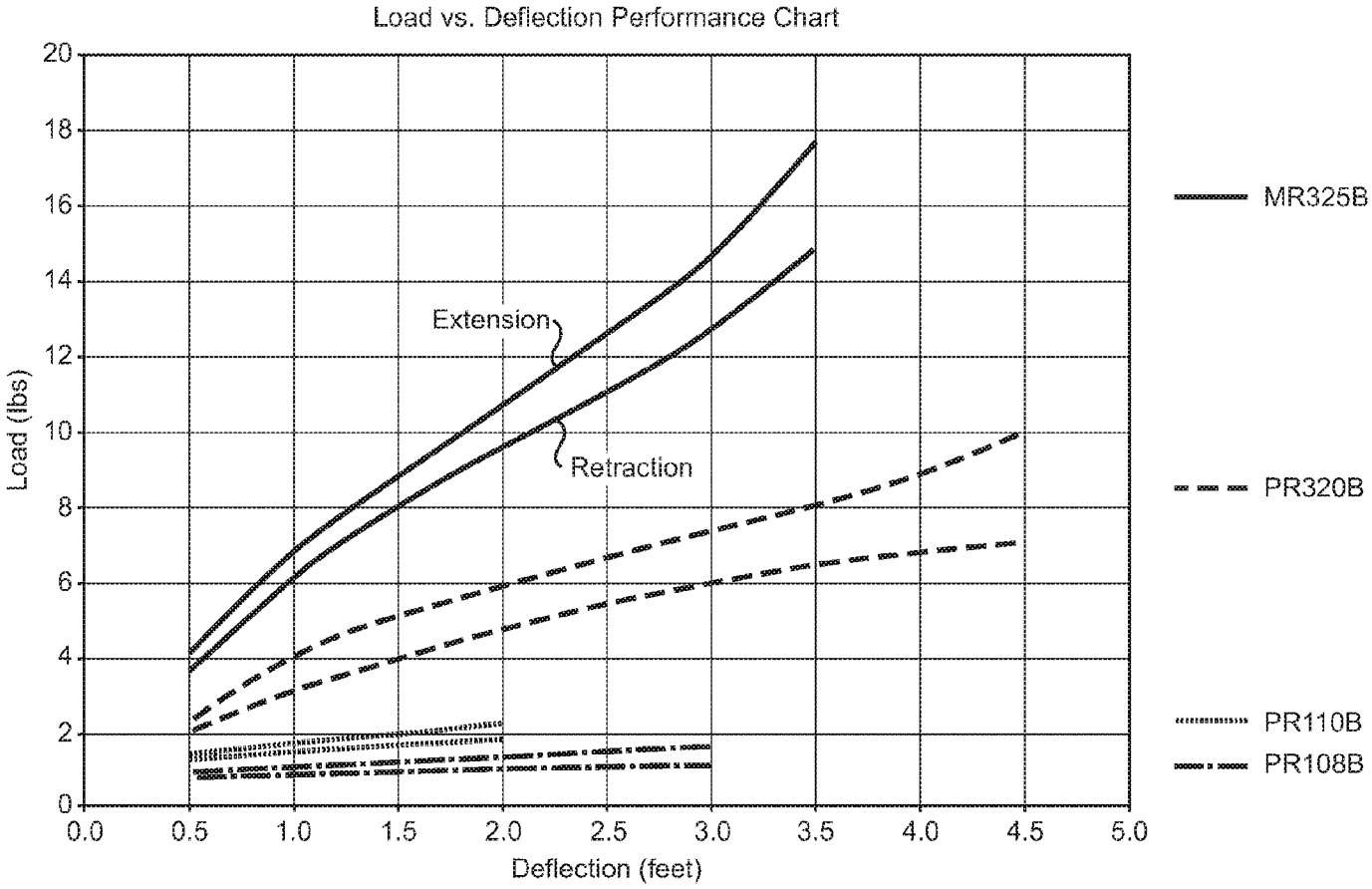
FIG. 7 is a chart of load versus deflection.

The spool core 56 can present a tapered surface from the second sidewall 60 to the first sidewall 58 whereby a progressively varying radius is provided for wrapping the respective cord 18 or 24. With a progressively varying radius, the spool core 56 tends to provide a greater consistency in resistance to an unwinding of the cord 18 or 24. This may be worthwhile, particularly where the resistance provided by the springs 54 is not perfectly consistent and proportional. Reference in this regard may be had to the chart of FIG. 7. The cord 18 or 24 can be wrapped around the spool core 56 such that it begins at the smaller diameter and un-winds to the larger diameter. Since a larger diameter of the spool core 56 will require less force at the handle 20 or 26, the forces at the respective handle 20 or 26 can be rendered substantially consistent over the entire length of extension of the cords 18 and 24 even where the resistance provided by the spring or springs 54 progressively changes.

This phenomenon can be better understood with reference to the formula for power springs:

$$F=(T\times 2)/D$$

Where F=force in lbs and T=spring torque and D=diameter of the spool.

In one example, therefore:

$$(12 \text{ in lbs torque}\times 2)/1.5 \text{ dia.}=16 \text{ lbs} \quad 1)$$

$$(12 \text{ in lbs torque}\times 2)/1.0 \text{ dia.}=24 \text{ lbs} \quad 2)$$

In use of the exercise system 10, the tapered spools 16 and 22 connect to the selected resistance packs 48, 50, and 52 using the central connecting rod portion 40A, 40B, or 40C of the respective key 30A, 30B, or 30C. The flexible cords 18 and 24 are wrapped around and affixed to the tapered spools 16 and 22 with the distal ends of the cords 18 and 24 affixed to respective handles 20 and 26. The first and second resistance mechanism 12 and 14 and the exercise system 10 in general can be retained relative to, by way of example and not limitation, a user's waist, such as by use of a belt 72 as in FIG. 11, a user's feet, such as by use of one or more foot plates 76 and 78 as is also shown in FIG. 11, or some other body part or external structure. The first and second resistance mechanisms 12 and 14 can be individually or collectively disposed in a shroud or housing 36 and, additionally or alternatively, retained relative to a base platform or member 70 as shown in FIG. 11 or some other structure. In one example of the invention, a belt or strap 72 can be connected to the first and second resistance mechanisms 12 and 14 or the housing 36 for retaining the exercise system 10 relative to the user's waist, feet, legs, or elsewhere. The housing 36 can include compartments or other means for retaining a plurality of keys 30 to permit ready adjustment of the resistance provided by the resistance mechanisms 12 and 14. With a resistance conveniently and intuitively selected by use of a key 30A, 30B, or 30C, a user can thus perform a wide variety of exercise movements by pulling on the handles 20 and 26 to unwind the cords 18 and 24 to overcome the resistance provided by the selected resistance pack or packs 48, 50, or 52.

Further reference may be had to the exercise system 10 shown in FIG. 11. There, the first resistance mechanism 12 and the second resistance mechanism 14 are secured to a base member 70, which could be substantially rigid. The first resistance mechanism 12 again has a rotatable spool 16, and a cord 18 is wound around the spool 16 with a handle 20 fixed to a distal end of the cord 18. The second resistance mechanism 14 has a rotatable spool 22, and a cord 24 is wound around the spool 22 with a handle 26 fixed to a distal end thereof. Shrouds 36 encase the spring stacks 28 and 32 of each resistance mechanism 12 and 14. A selective engagement of resistance selection keys 30 with the first and second spring stacks 28 and 32 permits varied resistance to be experienced by the user as discussed previously.

During use, the resistance mechanisms 12 and 14 and the exercise system 10 in general can be retained for operation by a user relative to the user's own body or relative to any appropriate external structure. In the embodiment of FIG. 11, the exercise system 10 has a retaining structure 68 that permits multiple, adjustable methods of retention. It will be understood, of course, that retaining structures 68 could be employed that permit just one method of retention or more methods of retention than expressly described herein.

In the present embodiment, the retaining structure 68 has a belt 72 secured to the base member 70. A belt fastener 74 permits the formation of the belt 72 into a continuous member. In this case, the belt fastener 74 comprises a snap lock fastener, but any other type of fastening construction could readily be used. The belt 72 can be adjustable in length to permit snug and secure retention of the exercise system 10 about bodies of varied circumferences. Under this construction, a user could stably retain the exercise system 10 about his or her waist, around one or both thighs, around his or her chest, around any given external structure, or in some other manner. With the exercise system 10 so retained and the resistance mechanisms 12 and 14 set to a given resistance, exercises can be done by pulling on one or both handles 20 and 26.

The depicted embodiment of the retaining structure 68 further includes first and second base platforms 76 and 78 that can be used to secure the exercise system 10 in a given configuration. In this example, the base platforms 76 and 78 project generally perpendicularly to the base member 70 and generally, but not necessarily exactly, parallel to the direction in which the axes of rotation of the resistance mechanisms 12 and 14 project. While first and second base platforms 76 and 78 are shown, it will be appreciated that a single, wider base platform 76 could be provided. Moreover, it could be possible for additional base platforms 76 and 78 to be included, such as to permit varied retaining configurations. The base platforms 76 and 78 can include straps 80 for selectively retaining the base platforms 76 and 78 relative to a given external structure and vice-versa. For instance, the straps 80, which could be retained by hook-and-loop combinations, fasteners, or in any other method, could be used to strap a user's feet in place relative to the platforms 76 and 78. Alternatively, the user could kneel on the platforms 76 and 78, and the straps 80 could encircle his or her shins, knees, or thigh. Of course, numerous other dispositions would be possible within the scope of the invention.

The base platforms 76 and 78 could be fixed in position relative to the base member 70. Alternatively, they could be pivotable between storage and use configurations. Still further, they could be removable and replaceable relative to the base member 70.

Where the first and second resistance mechanisms 12 and 14 are retained relative to a base member 70, they could be fixed in place at given locations and orientations. Alternatively, as depicted in FIG. 11, the first and second resistance mechanisms 12 and 14 could be adjustable retained in location and, additionally or alternatively, orientation. More particularly, in the exercise system 10 of FIG. 11, the base member 70 has channels 82 and 84 therein that permit the first and second resistance mechanisms 12 and 14 to slide laterally and, such as where the base member 70 is contoured, to adjust in angular orientation. The resistance mechanisms 12 and 14 could be selectively locked in given locations along the channels 82 and 84 in any appropriate manner. Under this construction, different exercises and variations of given exercises can be facilitated and the exercise system 10 can accommodate individual users and user preferences.

With certain details and embodiments of the present invention for an exercise system 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

The invention claimed is:

1. A selectively adjustable, portable exercise system comprising:

a first resistance mechanism comprising a rotatable spool, a cord wrapped around the rotatable spool, a handle secured to the cord, and a resistance stack;

wherein the rotatable spool has an engagement pattern;

wherein the resistance stack comprises a plurality of resistance packs;

wherein each resistance pack presents a resistance to rotation and wherein each resistance pack has an engagement pattern;

a plurality of keys wherein each key of the plurality of keys has a rod portion with an engagement pattern longitudinally spaced therealong the rod portion, and wherein the engagement pattern of each key has a spool engagement pattern and a resistance pack engagement pattern, the spool engagement pattern for engaging the engagement pattern of the rotatable spool to lock the rotatable spool relative to the key and the resistance pack engagement pattern for engaging the engagement pattern of one or more resistance packs of the plurality of resistance packs to lock the one or more resistance packs relative to the key and the rotatable spool, and wherein the resistance pack engagement patterns of at least some keys of the plurality of keys vary to lock different combinations of the one or more resistance packs relative to the key and the rotatable spool.

2. The exercise system of claim 1 further comprising a second resistance mechanism comprising a rotatable spool, a cord wrapped around the rotatable spool, and a handle secured to the cord wherein the rotatable spool of the second resistance mechanism has an engagement pattern, and a resistance stack, wherein the resistance stack of the second resistance mechanism comprises a plurality of resistance packs, wherein each resistance pack of the plurality of resistance packs of the second resistance mechanism presents a resistance to rotation, and wherein each resistance pack of the second resistance mechanism has an engagement pattern.

3. The exercise system of claim 1 wherein each resistance pack of the plurality of resistance packs presents resistance to rotation by operation of a spring and wherein the resistance pack presents resilient resistance to rotation.

4. The exercise system of claim 3 wherein the spring of each resistance pack comprises a coiled spring.

5. The exercise system of claim 4 wherein the spring of each resistance pack has a first end portion coupled to the resistance pack for rotation with the resistance pack and a second end fixed against rotation with the resistance pack.

6. The exercise system of claim 3 wherein at least some resistance packs of the plurality of resistance packs present different resistances to rotation.

7. The exercise system of claim 1 wherein the plurality of resistance packs nest together.

8. The exercise system of claim 7 wherein each resistance pack of the plurality of resistance packs has an annular hub that projects concentrically from a first side of the resistance pack and an annular receiving shoulder concentrically disposed to a second side of the resistance pack.

9. The exercise system of claim 1 wherein the plurality of resistance packs are modular and interchangeable.

10. The exercise system of claim 1 wherein each resistance pack has a concentric through-hole and wherein the engagement pattern of each resistance pack is disposed over the concentric through-hole.

11. The exercise system of claim 10 wherein the engagement patterns of the resistance pack and the plurality of keys comprise spline patterns.

12. The exercise system of claim 1 wherein the plurality of resistance packs are at least first, second, and third resistance packs and the plurality of resistance keys are at least first, second, and third keys, wherein the first key has a resistance pack engagement pattern for locking only the first resistance pack to rotate with the first key and the rotatable spool, wherein the second key has a resistance pack engagement pattern for locking the first and second resistance packs to rotate with the second key and the rotatable spool, and wherein the third key has a resistance pack engagement pattern for locking the first, second, and third resistance packs to rotate with the third key and the rotatable spool.

13. The exercise system of claim 1 wherein the rotatable spool has a spool core and first and second sidewalls and wherein the cord is wrapped around the spool core.

14. The exercise system of claim 13 wherein the spool core has a tapered outer surface from the second sidewall to the first sidewall.

15. The exercise system of claim 1 further comprising a second resistance mechanism comprising a rotatable spool, a cord wrapped around the spool, and a handle secured to the cord wherein the rotatable spool of the second resistance mechanism has an engagement pattern, and a resistance stack, wherein the resistance stack comprises a plurality of resistance packs, wherein each resistance pack of the plurality of resistance packs of the second resistance mechanism presents a resistance to rotation, and wherein each resistance pack of the second resistance mechanism has an engagement pattern and further comprising a retaining structure that retains the first and second resistance mechanisms.

16. The exercise system of claim 15 wherein the retaining structure comprises a belt whereby the exercise system is configured to be retained by an encircling with the belt.

17. The exercise system of claim 16 wherein the retaining structure further comprises at least one base platform whereby the exercise system is configured to be retained by a restraining force applied to the at least one base platform.

18. The exercise system of claim 17 wherein the at least one base platform is disposed generally perpendicularly to the belt.

19. The exercise system of claim 15 wherein the retaining structure comprises at least one base platform whereby the exercise system is configured to be retained by a restraining force applied to the at least one base platform.

20. The exercise system of claim 19 wherein the at least one base platform are first and second base platforms.

21. The exercise system of claim 19 wherein the at least one base platform projects generally parallel to an axis of rotation of the rotatable spool.

22. The exercise system of claim 19 further comprising at least one retaining strap retained relative to the at least one base platform.

23. The exercise system of claim 15 wherein the retaining structure comprises a base member and wherein the first and second resistance mechanisms are slidably retained relative to the base member.

* * * * *